US009364801B2

(12) United States Patent
Ehrlinger et al.

(10) Patent No.: US 9,364,801 B2
(45) Date of Patent: Jun. 14, 2016

(54) DEVICE FOR MIXING THE ADDITIVE COMPONENTS OF A MIXTURE PRODUCT TO BE ADDED TO A BASE COMPONENT OR MAIN COMPONENT

(75) Inventors: Klaus Ehrlinger, Fröndenberg (DE); Tobias Cherdron, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 99 days.

(21) Appl. No.: 13/513,878

(22) PCT Filed: Dec. 7, 2010

(86) PCT No.: PCT/EP2010/007408

§ 371 (c)(1),
(2), (4) Date: Jun. 5, 2012

(87) PCT Pub. No.: WO2011/101011

PCT Pub. Date: Aug. 25, 2011

(65) Prior Publication Data

US 2012/0236682 A1 Sep. 20, 2012

(30) Foreign Application Priority Data

Feb. 16, 2010 (DE) ..... 10 2010 008 165

(51) Int. Cl.
*B01F 15/02* (2006.01)
*B01F 3/04* (2006.01)
(Continued)

(52) U.S. Cl.
CPC ..... *B01F 3/04815* (2013.01); *B01F 3/088* (2013.01); *B01F 13/1055* (2013.01); *B01F 13/1066* (2013.01); *B01F 15/0201* (2013.01);
(Continued)

(58) Field of Classification Search
CPC ..... B01F 3/08
USPC ..... 366/162.1, 162.3, 165.1, 160.1, 160.2, 366/160.3, 160.4
See application file for complete search history.

(56) References Cited

U.S. PATENT DOCUMENTS 4,360,323 A * 11/1982 Anderson ..... 417/349
4,388,184 A * 6/1983 Brous et al. ..... 210/96.2
(Continued)

FOREIGN PATENT DOCUMENTS

DE 2220224 1/1973
DE 1632406 4/1974
(Continued)

OTHER PUBLICATIONS

"How to Drain and Refill Your Swimming Pool" http://www.wikihow.com/Drain-and-Refill-Your-Swimming-Pool.*

*Primary Examiner* — Tony G Soohoo
*Assistant Examiner* — Anshu Bhatia
(74) *Attorney, Agent, or Firm* — Occhiuti & Rohlicek LLP

(57) ABSTRACT

An apparatus for batched mixing of an additive component from individual components for mixture products containing the additive component and for temporarily storing the additive component, which is part of a mixer for forming the mixture products by mixing an additive component with a base component includes a single batch tank connected by at least a control valve and/or a proportioning valve to connections supplying the individual components for proportioned introduction of the individual components. The single batch tank is connected to a mixing and buffer tank arranged on a level below the single batch tank for temporary storage of the mixed additive component.

27 Claims, 2 Drawing Sheets

(51) Int. Cl.
*B01F 3/08* (2006.01)
*B01F 13/10* (2006.01)
*B01F 15/04* (2006.01)

(52) U.S. Cl.
CPC ..... *B01F 15/0258* (2013.01); *B01F 15/0441* (2013.01); *B01F 2003/049* (2013.01); *B01F 2215/0052* (2013.01)

(56) References Cited

U.S. PATENT DOCUMENTS 4,508,622 A * 4/1985 Polaschegg et al. ..... 210/96.2
4,640,840 A * 2/1987 Assinder et al. ..... 426/399
4,857,355 A 8/1989 Gregg
5,537,914 A * 7/1996 Gibney et al. ..... 366/132
6,361,201 B1 * 3/2002 Russell ..... B01F 1/0038 366/136
2010/0224256 A1 * 9/2010 Tseng ..... B24B 37/04 137/2
2011/0071252 A1 * 3/2011 Prince et al. ..... 366/142

FOREIGN PATENT DOCUMENTS

DE 3132706 3/1983
DE 4232773 3/1994
DE 4237933 5/1994
DE 29617228 10/1997
EP 0479113 4/1992
WO 99/41002 8/1999
WO 2005/019788 3/2005

* cited by examiner

DEVICE FOR MIXING THE ADDITIVE COMPONENTS OF A MIXTURE PRODUCT TO BE ADDED TO A BASE COMPONENT OR MAIN COMPONENT

CROSS REFERENCE TO RELATED APPLICATIONS

This application is the national stage entry under 35 USC 371 of International Application No. PCT/EP2010/007408, filed Dec. 7, 2010, which claims the benefit of the Feb. 16, 2010 priority date of German Application No. 10 2010 008 165.5. The contents of the aforementioned applications are incorporated herein in their entirety.

FIELD OF DISCLOSURE

This disclosure relates to mixing devices for mixing products, and in particular, to a device for batched mixing of an additive component.

BACKGROUND

For the production of mixture products, one generally combines am additive component with a base component. The additive component is itself made by mixing individual components. Examples of additive components include components that provide flavor, and/or color, as well as components that promote preservation of the mixture product. Examples of mixture products include drinks, such as mixed drinks, including soft drinks or lemonades. An example of a base component is water.

A typical plant for mixing drinks includes a tank for degassing the base component, one or more admixture devices and/or mixing sections for the metered admixture of the additive component, an optional carbonating device for carbonating the mixed drink, and a storage device for temporarily storing the mixed drink.

In the case of mixed drinks, the additive component is sometimes referred to as "syrup." The syrup is usually premixed from the individual components in a separate premixing space, which is often called a "syrup space." The syrup is then brought from this syrup space to a mixing device. At the mixing device, the syrup is diluted and blended with the degassed base component until it reaches its final concentration. The degassed base component is typically water Within the syrup space, known devices for the pre-proportioning or premixing of the additive components in the separate syrup space feed individual components into an associated batch tank. To ensure proportionality, they typically do so under the control of flow-meters or load cells. These known devices either use very large receiver tanks or alternate between two batch tanks that are connected in parallel. The two batch tanks are usually designed to hold enough volume so that one can fill continuously while the other is being refilled.

One disadvantage of these known devices is that all arriving or departing pipes, including fittings, mixing pumps, and mixing systems, must be replicated. Another disadvantage is the high investment costs that arise as a consequence of both the need to replicate all these parts, and the need to provide such large container volumes.

Other known methods and mixing devices are configured for inline proportioning. In such devices, the individual components are introduced into the mixer in parallel inline into the base component.

One disadvantage of these mixing devices arises from their considerable technical complexity. Each individual component requires its own proportioning leg. Each such leg will include, among other things, a header vessel, a level measurement, a feed controller, a pump, flow-meters, and a volume control valve.

A further disadvantage of the mixing device is that the pumps are running most of the time. As a result, these pumps will heat up. Inevitably, this heat is transferred to the individual components. If the volumes of liquid are large, this heat is easily dissipated without causing a significant temperature rise. However, the individual components are used in only small amounts. As a result, waste heat from the pump can be enough to raise their temperature considerably. This heating can result lead in product damage.

In known methods for inline proportioning, it is desirable to make redundant measurements of the added individual components to ensure product quality. In particular, it is desirable to check measured-data provided by flow-meters, such as mass flow-meters and volumetric flow-meters, or to check data provided by weighing scales used for the proportioning, as well as to execute inline control measurement methods for detecting faulty measurements or incorrect proportions. In known devices, these redundant measurements are either not possible or highly complex.

SUMMARY

The invention provides a way to significantly reduce the investment volume for a complete plant for producing mixture products, in particular mixed drinks.

In one aspect, the invention integrates a device for mixing individual constituents to form an additive component into a mixer that adds this additive component to a base component, such as water. This eliminates the need to provide a separate premixing space or syrup space, this configuration achieves a considerable reduction in the investment volume of a complete plant.

When the mixture product is a mixed drink, examples of an additive component include a flavoring component, a coloring component, a preserving component, or any combination thereof.

In another aspect, the invention features an apparatus with only a single batch tank for the mixing of an additive component from its individual components. During each proportioning cycle, all individual components required by a recipe for the additive component are introduced in a proportioned manner. Preferably, these individual components are introduced one after the other. At the end of each proportioning cycle the resulting additive component is drained into a buffer tank through a liquid connection, preferably in free fall. As a result, intensive blending of the individual components already occurs in the liquid connection, before the additive component reaches the buffer tank.

As used herein, the phrase "batched mixing of the additive components" refers to a process in which additive component is made in batches rather than continuously. Such a process is divided into proportioning cycles. During each such proportioning cycle, individual components of an additive component are fed into a batch tank in the correct proportions. The batch tank is then emptied into a mixing-and-buffer tank.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE FIGURES

The invention is explained in detail below through the use of an exemplary embodiment and with reference to the figures, in which.

DETAILED DESCRIPTION

Figure 1:
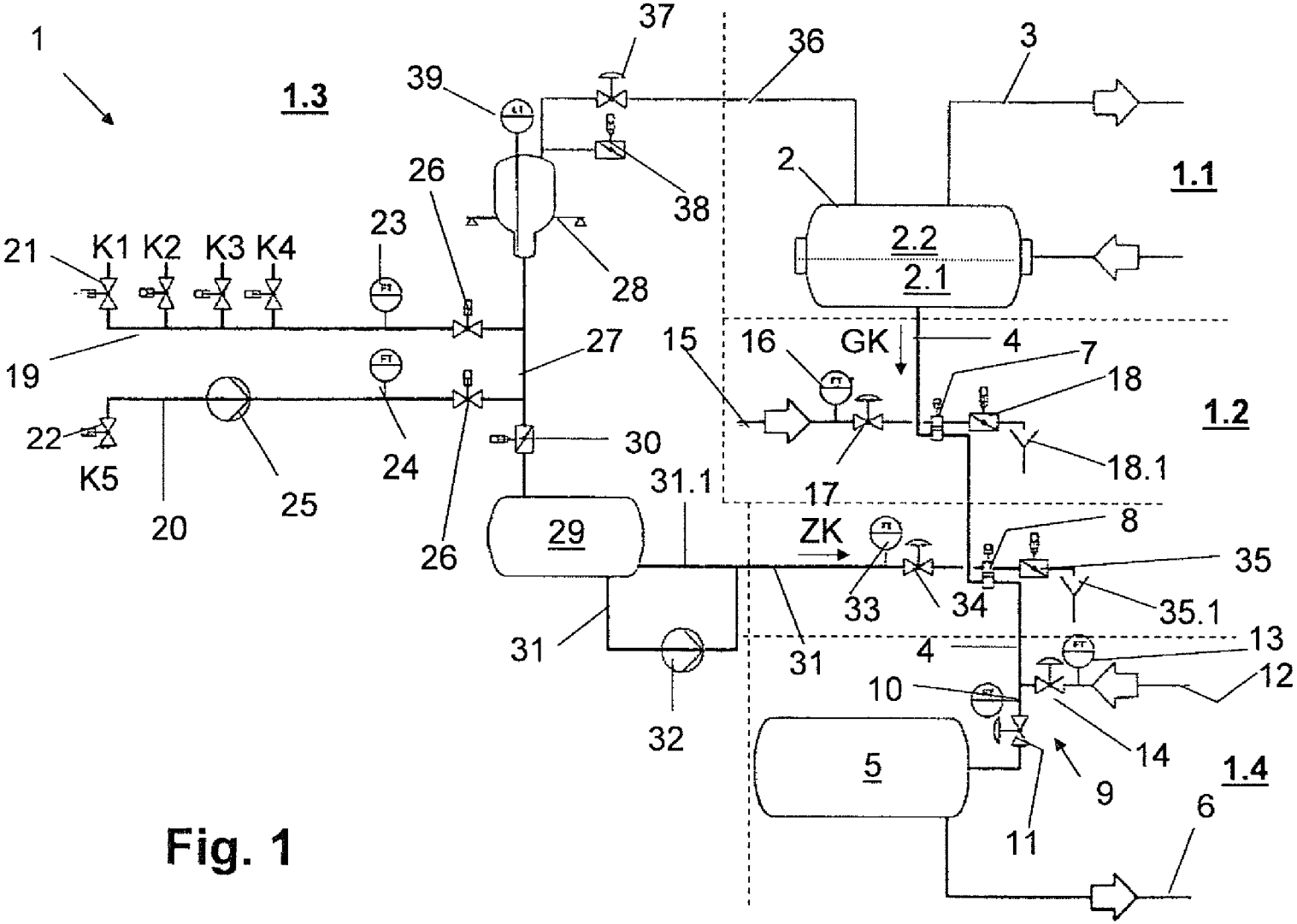
FIG. 1 shows, in a simplified function diagram, a mixing plant or mixing device for mixing a base component with a syrup, with the syrup itself being made from at least two individual components.

FIG. 1 shows a mixing device 1 that produces mixture products, such as drinks. The mixing device 1 does so by mixing a liquid base component GK with an additive component ZK, carbonating the resulting mixture, and then storing it. The base component GK is typically water. The additive component ZK is usually a blended syrup.

The blended syrup is a flavoring component, a coloring component, and/or a component that promotes preservation. To make the additive component ZK, one mixes a plurality of individual components K1-K5. The individual components usually include a dominant component K5 and subdominant components K1-K4. The dominant component K5 is the component that is used in the largest quantity when making the additive component ZK.

The mixing device 1 has four functionally distinct plant sections 1.1-1.4. These plant sections are: a base-preparation section 1.1, a mixture-product mixing section 1.2, an additive-component mixing section 1.3, and a carbonation section 1.4.

The base-preparation section 1.1 prepares the base component GK by degassing. The additive-component mixing section 1.3 mixes the additive component ZK from individual components K1-K5 according to a particular predetermined recipe. The mixture-product mixing section 1.2 then takes one or more additive components ZK and admixes them into the base component GK to form a mixture product. Finally, the carbonation section 1.4 carbonates and buffers the mixture product.

The base-preparation section 1.1 comprises a base-component tank 2 to which the base component GK is fed in the required quantity during the operation of the mixing device 1 in such a way that the base-component tank 2 is partly filled under level control with the base component GK. The base-component tank 2 has a lower liquid space 2.1 and a gas space 2.2 that lies above the liquid space 2.1. A vacuum line 3 connects the gas space 2.2 to a vacuum source, such as a vacuum pump. This permits degassing the base component GK.

A base-supply line 4 carries the base component GK from the base-component tank 2 to a point at which it combines with additive component ZK and becomes mixture product. The base-supply line 4 then continues on to a buffer tank 5. A product line 6 connects the buffer tank 5 to a filling machine (not shown) for filling containers with the mixture product.

In the depicted embodiment, the base-supply line 4 has a first base-supply-line connection-valve 7 and a second base-supply-line connection-valve 8. The first base-supply-line connection-valve 7 and the second base-supply-line connection-valve 8 are disposed sequentially in the direction of flow from the base-component tank 2 to the buffer tank 5.

The first base-supply-line connection-valve 7 introduces concentrated aqueous sugar solution into the base component GK to sweeten the mixture product. A suitable sugar solution is a 70% sugar solution. The second base-supply-line connection-valve 8 introduces additive component ZK into the base component GK.

In the direction of flow following the second base-supply-line connection-valve 8, a section of the base supply-line 4 upstream of the buffer tank 5 forms a carbonating leg 9 in which in-line carbonating takes place. Within the carbonating leg 9, the base supply-line 4 has a carbonating-leg flow-meter 10.

Downstream of the carbonating-leg flow-meter 10, just before the buffer tank 5, is a buffer-tank flow control valve 11. Upstream of the carbonating-leg flow-meter 10, a CO2 line 12 opens via at least one nozzle orifice. The CO2 line 12 connects to a CO2 source (not shown) that provides pressurized CO2 gas. The CO2 line 12 has a CO2 flow-meter 13 for measuring the quantity of CO2 gas flowing through it, and a CO2 flow-metering valve 14. Control electronics (not shown) controls the CO2 flow-metering valve 14 as a function of measurement signals from the CO2 flow-meter 13 and the carbonating-leg flow-meter 10 such that the mixture product has the specified CO2 content after inline carbonation on the carbonating leg 9.

For the proportioned addition of sugar or sugar-concentrate, a sugar line 15 connects the open first base-supply line connection valve 7 to a source of sugar concentrate. Proceeding along the sugar line 15 starting from the source of sugar concentrate, there is a sugar-line flow-meter 16, a sugar/large component flow-metering valve 17, the first base-supply-line connection-valve 7, and a shut-off or gully valve 18. During actual admixing of sugar to the base component GK, the gully valve 18 remains closed. When purging or cleaning the sugar line 14, the gully valve 18 opens to drain the sugar line 15 into a sugar-line drain 18.1.

Admixing the liquid sugar through the first base-supply line connection valve 7 directly into the base component GK significantly reduces the throughput demand on the additive-component mixing section 1.3. However, liquid sugar can also be added in the additive-component mixing section 1.3. In such cases, the liquid sugar would usually be the dominant component K5.

The additive-component mixing section 1.3 is what makes the additive component ZK. It is here that the proportioned mixing of additive component ZK from individual components K1-K4 takes place.

The additive-component mixing section 1.3 comprises a shared proportioning line 19 and a dedicated proportioning line 20. The shared proportioning line 19 is shared among the subdominant components K1-K4. The dedicated proportioning line 20 is dedicated to the use of the dominant component K5.

Separate individual-component supply valves 21 form separate connections between the shared proportioning line 19 and sources of the individual components K1-K4. The individual components K1-K4 are components that are present in the additive component ZK in very small amounts, and thus form a very small mass fraction.

A dominant-component supply valve 22 forms a connection between the dedicated proportioning line 20 and a source of the dominant component K5. The dominant component K5 is the component that forms the greatest mass fraction or quantity fraction in the additive component ZK. A shared-proportioning line flow-meter 23 is provided in the shared proportioning line 19. Similarly, a dedicated proportioning line flow-meter 24 is provided in the dedicated proportioning line 20. The shared-proportioning line flow-meter 23 and the dedicated-proportioning line flow-meter 24 can be mass flow-meters or volumetric flow-meters. A proportioning feed pump 25 is also provided in the dedicated proportioning line 20 upstream of the second flow-meter 24.

In the direction of flow of the components K1-K5 and downstream respectively of the fourth and fifth flow-meters 23, 24, corresponding first and second proportioning-line valves 26 connect the shared and dedicated proportioning lines 19, 20 to a master line 27. The master line 27 connects a lower inlet and outlet of a header or a batch tank 28 to a mixing-and-buffer tank 29. The mixing-and-buffer tank 29, which is beneath the batch tank 28, holds the additive component ZK. A master-line shut-off valve 30 in the master line 27 provides a way to interrupt the connection between the mixing-and-buffer tank 29 and the master line 27, the dedicated proportioning-line 20, and the shared proportioning-line 19.

An additive-component-supply line 31 connects to the outlet of the mixing-and-buffer tank 29 for carrying additive component ZK. Along the additive-component-supply line 31 are, starting from mixing-and-buffer tank 29, a proportioning or circulation pump 32, a sixth flow-meter 33, which can be a mass flow-meter or a volumetric flow-meter, a concentrate-flow metering valve 34, the second base-supply line connection valve 8, and a shut-off or gully valve 35 with which the end of the additive-component-supply line 31 that is away from the mixing-and-buffer tank 29 can be either closed or drained towards a second drain 35.1.

The rated flow of the proportioning-or-circulating pump 32 is set so that its generated volumetric flow exceeds the maximum amount of additive component ZK that is to be admixed to the base component GK. The partial quantity of additive component ZK that is not required is returned to the mixing-and-buffer tank 29 through an additive-component-return line 31.1. The admixing of additive component ZK to the base component GK is effected when the second base-supply-line connection-valve 8 is open through the concentrate-flow metering valve 34. This opening is triggered by the control electronics as a function of the signals from the sixth flow-meter 33 and a further flow-meter provided in the base line 4. A suitable flow-meter provided in the base line 4 is the carbonating-leg flow-meter 10.

In a proportioning cycle, the individual components K1-K5 are proportioned in chronological order or are introduced into the batch tank 28 in the quantities and/or fractions according to the particular recipe as a function of the measurement signals of the fourth and fifth flow-meters 23, 24, with at least one of components K1-K4 being aspirated by vacuum. This aspiration results from having the batch tank 28 be connected to a gas space 2.2 of the tank 2 by a vacuum line 36 that has a vacuum-regulating valve 37. This avoids the need for an additional vacuum source.

In some cases, it is desirable to separate the individual components in the shared proportioning line 19 and the master line 27 during the proportioning cycle. This can be achieved by having one of individual components K1-K4 be water. In such cases, briefly opening the associated individual-component supply valve 21 results in passage of a water plug through the shared proportioning line 19 and the master line 27 into the batch tank 28.

In some embodiments, a proportioning feed pump 25, with possible assistance of a vacuum, introduces the dominant component K5 into the batch tank 28. However, other embodiments dispense with the proportioning feed pump 25 by sucking the dominant component K5 into the batch tank 28 in a proportioned manner as well.

Among the advantages of using a dedicated proportioning line 20 for the dominant component K5 is that the subdominant components K1-K4 can be proportioned with greater accuracy through an appropriate configuration of the fourth and fifth flow-meters 23, 24. The use of a dedicated proportioning line 20 also allows the proportioning of the dominant component K5 to be carried out at the same time as the proportioning of subdominant components K1-K4.

Once all individual components K1-K5 that are required by the recipe for the additive component ZK have been introduced into the batch tank 28, the proportioning cycle ends. At this point, the proportioning line valves 26 close and the master-line shut-off valve 30 opens. This empties the content of the batch tank 28 into the mixing-and-buffer tank 29.

The arrangement is preferably selected such that after the master-line shut-off valve 30 has been opened, the content of the batch tank 28 can flow through the master line 27 in free fall or flow. As the individual components fall, they mix together. Accordingly, the master line 27 is designed with a suitably large cross-section. As it is being emptied, a vent valve 38 opens to bring the batch tank 28 to ambient pressure. It is also possible to accelerate the emptying by pressurizing the batch tank 28.

It is particularly advantageous to redundantly measure and/or check whether the individual components, and in particular, of the subdominant components K1-K4, are being added in the correct proportions. There are three ways to do this: measuring flow, weighing, and inspecting a liquid level.

The first way to perform such a check is to have a further flow-meter and/or a level-meter 39 at either the inlet or the outlet of the batch tank 28. The second way is to have weigh scale that weighs how much of each individual component K1-K5 is introduced into the batch tank 28. The third way is to measure the height of the liquid level in the batch tank 28. When this third method is used, having different diameters in different sections of the batch tank 28, as shown in the figure, will enhance measurement accuracy.

Regardless of which method is used, the redundancy measurement can be carried out in all cycles for all individual components K1-K5. To save time, however, this can also be done at intervals, for example per batch or cycle, and only for whichever individual component is first introduced into the batch tank 28. In this case, the individual component that is first introduced into the batch tank 28 changes randomly. Alternatively, individual components take turns being the first to be introduced into the batch tank 28.

In some embodiments, the batch tank 28 has a small enough volume so that the time required to individual components in the correct proportions, when added to the time required to empty the batch tank 28 into the mixing-and-buffer tank 29 is very short cycle. In some of these embodiments, these two times, when added together, amount to under five minutes.

Some embodiments include partitions that divide the interior of the mixing-and-buffer tank 29. This provides the mixing-and-buffer tank 29 with a rudimentary "first-in/first-out characteristic."

In some embodiments, return feeding of the partial stream through the vacuum line 31.1 promotes blending of the individual components in the mixing-and-buffer tank 29. As a result, at least for certain suitable products, there is no need for mechanically actuated mixing and/or agitating elements to ensure complete mixing of additive component ZK.

Figure 2:
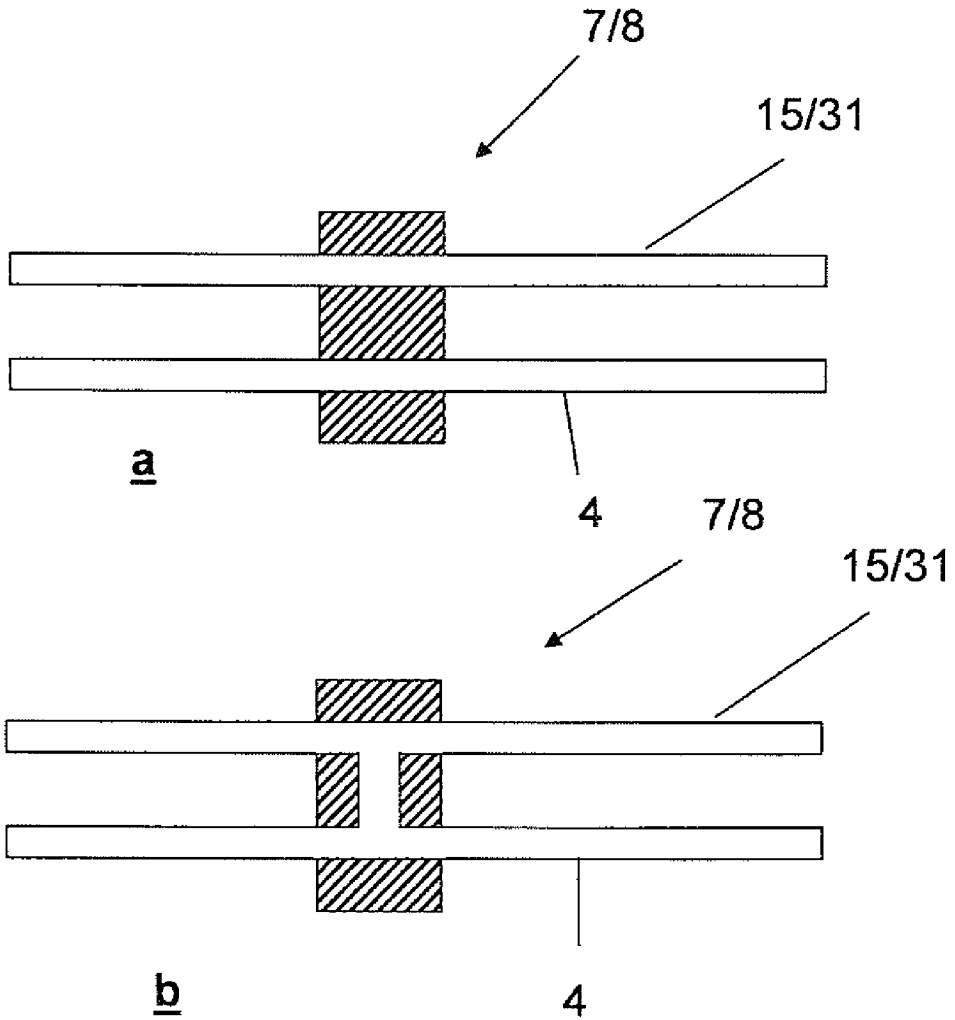
FIG. 2 shows a schematic functional representation of a closed cross-valve (item a) and open cross-valve (item b).

The first and second base-supply-line connection valves 7, 8 are preferably cross valves having a configuration that transitions between an open state, shown in FIG. 2(*b*), and a closed state, shown in FIG. 2(*a*). An open state of the base-supply-line connection valves 7, 8 forms a connection between the sugar line 15, the additive-component-supply line 31, and the base-supply line 4. A closed state of the base-supply-line connection valves 7, 8 blocks this connection and also makes it possible to purge the sugar line 15 or the additive-component-supply line 31 after opening the gully valve 18, 35, for example during a working cycle of mixing device 1 when the connection is not needed.

At the end of the filling of a certain product or certain product batch, while the mixing-and-buffer tank 29 is being emptied, additive component ZK can already be prepared in the batch tank 28 for the next product batch according to the new recipe and can then be drained off into the mixing-and-buffer tank 29 after the latter has been completely emptied or run empty.

A mixing device 1 as described herein can be used to produce mixture products based on a recipe by mixing a base component GK with at least one individual component K1-K5, and with all the individual components K1-K5 standing ready at the corresponding connections of the shared and dedicated proportioning lines 19, 20 but with the controlled opening of the individual-component supply valves 21 and the dominant-component supply valve 22 only introducing those individual components K1-K5 into the batch tank 28 that are actually needed for the current recipe.

The invention has been described hereinbefore by reference to one embodiment. It goes without saying that numerous variations and modifications are possible without departing from the inventive concept underlying the invention.

The invention claimed is:

1. An apparatus for batched mixing of at least a first liquid individual component and a second liquid individual component to form an additive component and to store said additive component, said apparatus being part of a mixer for forming a mixture product by mixing said additive component with a base component, said apparatus comprising a first fluid connection, a first valve, a single-batch tank, a second fluid connection, a mixing-and-buffer tank, a second valve, a master line, and a vacuum source, wherein said first fluid connection is a physical line that connects to a source of said first individual component, wherein said first valve connects said single-batch tank to said first fluid connection, wherein said vacuum source is configured for vacuum-assisted feeding of said first and second individual components into said single-batch tank, and away from said mixing-and-buffer tank, wherein, in operation, said vacuum source causes a pressure difference that urges a component to move away from said mixing-and-buffer tank and toward said single-batch tank, wherein said second fluid connection is a physical line that connects to a source of said second individual component, wherein said master line connects said mixing-and-buffer tank to said single-batch tank, wherein said second valve connects said single-batch tank to said second fluid connection, wherein said mixing-and-buffer tank provides temporary storage of said additive component and is located upstream of where said additive component and said base component are first mixed together, wherein said mixing-and-buffer tank is arranged on a level below said single-batch tank such that said first individual component and said second individual component are discharged in free fall into said mixing-and-buffer tank, wherein, in operation, said first individual component is a liquid that flows through said first fluid connection, wherein, in operation, said second individual component is a liquid that flows through said second fluid connection, wherein, in operation, said first fluid connection supplies said first individual component for mixing to make said additive component, wherein, in operation, said second fluid connection supplies said second individual component for mixing to make said additive component, wherein said first and second fluid connections are connections that are configured for connecting to a source of liquid, and wherein said first valve is selected from the group consisting of a proportioning valve and a control valve.

2. The apparatus of claim 1, further comprising a source of negative pressure, wherein said source of negative pressure is configured for feeding said individual components into said single-batch tank by negative pressure.

3. The apparatus of claim 1, further comprising a common proportioning line and a plurality of valves, wherein said common proportioning line receives individual components from each of said fluid connections, wherein each valve from said plurality of valves is connected to said common proportioning line, wherein each valve from said plurality of valves controls flow of one of said individual components into said common proportioning line, wherein, said plurality of valves has, as an intended use thereof, controlling flow of individual components, wherein, to implement said intended use, said plurality of valves comprises structure for causing said valves to engage time-delayed proportioned introduction of said individual components into said single-batch tank during a proportioning cycle.

4. The apparatus of claim 3, further comprising means for at least one of capturing and measuring of a particular quantity of each individual component introduced during a proportioning cycle into said single-batch tank, said means for at least one of capturing and measuring comprising a measuring device arranged in at least one proportioning line.

5. The apparatus of claim 4, wherein said measuring device comprises a flow meter.

6. The apparatus of claim 1, further comprising a dedicated proportioning line that is connected to a source of an associated individual component, said apparatus having, as an intended purpose thereof, control over relative amounts of individual components, wherein, in order to implement said intended purpose, said apparatus further comprises structure for achieving said intended purpose by controlling valves to cause said associated individual component to be present in an amount that, compared with other individual components, constitutes the greatest fraction in the mixed additive component.

7. The apparatus of claim 1, further comprising a circuit for said additive component, said circuit comprising said mixing-and-buffer tank and a pump, wherein said pump is configured for delivering said additive component to a mixing location where admixing of said additive component to said base component takes place, wherein said pump is selected from the group consisting of a proportioning pump and a circulating pump, and wherein said mixing location is selected from the group consisting of a mixing section and a mixing position.

8. The apparatus of claim 1, wherein said single-batch tank comprises an inlet and outlet, wherein said inlet and said outlet of said single-batch tank are connected by a controlled liquid connection to said mixing-and-buffer tank, wherein said apparatus has, as an intended use thereof, dividing time into proportioning cycles and causing feeding of different individual components during different proportioning cycles, wherein, to implement said intended use, said apparatus further comprises structure that causes proportioned feeding of said individual components into said single-batch tank takes place during a respective proportioning cycle, and wherein said structure further causes draining of said individual components from said single-batch tank takes place over said controlled liquid connection following completion of said respective proportioning cycle.

9. The apparatus of claim 1, further comprising means for at least one of capturing and measuring of a particular quantity of each individual component introduced during a proportioning cycle into said single-batch tank, said means for at least one of capturing and measuring comprising a measuring device arranged in at least one proportioning line.

10. The apparatus of claim 9, wherein said measuring device comprises a flow meter.

11. The apparatus of claim 1, wherein said single-batch tank comprises an independent measuring device for at least one of capturing and measuring a quantity of at least one individual component introduced into said single-batch tank during a respective proportioning cycle.

12. The apparatus of claim 1, further comprising a degassing element that is used for degassing said base component, wherein degassing element provides a vacuum for feeding individual components into said single-batch tank, and wherein an interior of said single-batch tank is connected by a controlled connection to an interior of said degassing element.

13. The apparatus of claim 1, further comprising a cross valve, wherein said mixing-and-buffer tank is connected, via said cross valve, to said mixing location for admixing said additive component into said base component.

14. The apparatus of claim 13, wherein said cross-valve comprises a first port, a second port, a third port, a fourth port, a first fluid connection, a second fluid connection, and a third fluid connection, wherein said first fluid connection connects said first port to said second port, wherein said second fluid connection connects said third port to said fourth port, wherein said cross-valve is configured to transition between a first state and a second state, wherein in said first state, said first connection and said second connection are isolated from each other, and wherein in said second state, said third fluid connection connects said first fluid connection and said second fluid connection.

15. The apparatus of claim 1, further comprising a valve between the single-batch tank and the mixing-and-buffer tank.

16. An apparatus for making a mixture product, said apparatus comprising a mixer for forming said mixture product by mixing individual components to make an additive component, and to then mix said additive component with a base component, wherein said mixer comprises a source of negative pressure, a first connection, a source of a first individual component, a source of a second individual component, a second connection, a source of said base component, a third connection, a source of said additive component, and a fourth connection, wherein said source of said additive component comprises a batch mixer, wherein said first connection comprises a line that connects said source of said first individual component to said batch mixer, wherein said batch mixer comprises a single-batch tank, a first control valve, a first proportioning valve, a second proportioning valve, a vacuum source, and a mixing-and-buffer tank, wherein said mixing-and-buffer tank has, as an intended use thereof, to cause individual components falling therein to be mixed, wherein, in order to carry out said intended function, said mixing-and-buffer tank comprises structure, wherein said structure of said mixing-and-buffer tank comprises walls forming an empty space into which for individual components that have been dropped in free fall from said single batch tank land, wherein to mixing in said mixing-and-buffer tank occurs as a result of individual components falling onto said mixing-and-buffer tank from said single-batch tank, wherein said third connection comprises a line that connects said source of said base component to said source of said additive component, wherein said second connection comprises a line that connects said source of said second individual component to said batch mixer, wherein said batch mixer is configured to mix a first quantity of said first individual component and a second quantity of said second individual component to make said additive component, wherein a ratio of said first quantity to said second quantity is a fixed ratio, wherein said batch mixer is configured to temporarily store said additive component, which comprises a constant ratio of said first individual component and said second individual component, wherein said first proportioning valve is connected to control flow of said first individual component along said first connection from said source of said first individual component toward said first control valve, wherein said second proportioning valve is connected to control flow of said second individual component along said second connection from said source of said second individual component toward said first control valve, wherein said first control valve is disposed to receive a mixture that comprises said first individual component and said second individual component, wherein said fourth connection connects said single-batch tank to said mixing-and-buffer tank for temporary storage of said additive component, wherein said fourth connection extends along a fourth-connection direction, wherein said mixing-and-buffer tank is arranged on a level below said single-batch tank such that said individual components are discharged to fall freely through said fourth connection along said fourth-connection direction and into said mixing-and-buffer tank, and wherein said source of negative pressure is disposed to cause said first individual component and said second individual component to be fed into said single-batch tank by negative pressure, wherein said source of negative pressure is disposed to cause a fluid disposed in a region to experience a pressure force such that net force experienced by said fluid will accelerate said fluid in a direction of decreasing pressure, wherein said direction of decreasing pressure is a direction that is opposite said fourth-connection direction, and wherein said source of negative pressure is disposed to move said individual components in a direction opposite said fourth-connection direction.

17. The apparatus of claim 16, further comprising a common proportioning line that extends between said first control valve and said first and second connections.

18. The apparatus of claim 17, further comprising a first individual component and a second individual component, wherein, during a first interval of operation, said common proportioning line is filled only with said first individual component, and during a second interval of operation, said common proportioning line is filled only with said second individual component.

19. The apparatus of claim 18, wherein said second interval randomly follows said first interval.

20. The apparatus of claim 17, further comprising a flowmeter in said proportioning line for measuring a quantity of said first individual component introduced into said single-batch tank during a proportioning cycle and for measuring a quantity of said second individual component introduced into said single-batch tank during said proportioning cycle.

21. The apparatus of claim 16, further comprising said first individual component, said second individual component, and said additive component, wherein said first individual component is disposed in said first connection, wherein said second individual component is disposed in said second connection, and wherein said additive component is disposed in said mixing-and-buffer tank.

22. The apparatus of claim 16, further comprising a source of a third individual component, a fourth connection, a second control valve, and a dedicated line, wherein said fourth connection connects said source of said third individual component, wherein said fourth connection connects to said dedicated line, wherein said dedicated line connects to said second control valve, wherein said dedicated line carries only said third individual component, wherein said apparatus has, as an intended use thereof, controlling relative volumes of individual components, wherein, to implement said intended use, said apparatus further comprises structure that causes said additive component to comprise said third individual component in addition to said first individual component and said second individual component in an amount such that for a fixed volume of said additive component, a volume of said third component present in said fixed volume present is greater than a volume of said second component present in said fixed volume, and such that, for a fixed volume of said additive component, a volume of said third component present in said fixed volume present is greater than a volume of said first component present in said fixed volume.

23. The apparatus of claim 16, further comprising a circuit for said additive component, wherein said circuit comprises said mixing-and-buffer tank and a pump, wherein said pump is configured for delivering said additive component to a location at which said additive component is to be mixed with said base component, wherein said location is selected from the group consisting of a mixing section and a mixing position, and wherein said pump is selected from the group consisting of a proportioning pump and a circulating pump.

24. The apparatus of claim 16, wherein an inlet and outlet of said single-batch tank are connected by a controlled liquid connection to said mixing-and-buffer tank, wherein said apparatus has, as an intended use thereof, proportioned feeding of said individual components into said single-batch tank place during a respective proportioning cycle, wherein said apparatus further comprises structure for causing proportioned feeding of said individual components into said single-batch tank to take place during a respective proportioning cycle, wherein said apparatus has, as a further intended use thereof, controlling drainage of said single-batch tank, wherein said apparatus further comprises structure for causing drainage of said individual components from said single-batch tank to take place over said controlled liquid connection following completion of said respective proportioning cycle.

25. The apparatus of claim 16, wherein said mixer comprises a degasser for degassing said base component, and a controlled connection between said single-batch tank and said degasser.

26. The apparatus of claim 16, further comprising a cross-valve, wherein said cross-valve is connected to said mixing-and-buffer tank, wherein said cross-valve is connected to a pipe containing said base component, wherein said cross-valve transitions between an admixing state and a purging state, wherein, in said admixing state, a connection exists to enable said additive component to mix with said base component, wherein in said purge state, said connection is disrupted, and wherein in said purge state, said cross-valve is connected to a source of purging fluid.

27. The apparatus of claim 16, wherein said plurality of tanks further comprises a second tank, a third tank, and a fourth tank, wherein said plurality of pipes further comprises a second pipe, a third pipe, a fourth pipe, a fifth pipe, a sixth pipe, a seventh pipe, an eighth pipe, and a ninth pipe, wherein said valve arrangement comprises a first valve, a second valve, and a third valve, wherein said fifth pipe connects to a first liquid source, wherein said sixth pipe connects to a second liquid source, wherein said fifth pipe connects to said first valve, wherein said sixth pipe connects to said second valve, wherein said eighth pipe connects to said first valve, wherein said eighth pipe connects to said second pipe, wherein said ninth pipe connects to said second valve, wherein said ninth pipe connects to said second pipe, wherein said second pipe connects to said third valve, wherein said seventh pipe connects to said third valve, wherein said first pipe connects to said first tank, wherein said first pipe connects to said seventh pipe, wherein said first pipe connects to said second tank, wherein said third pipe connects to said second tank, wherein said third pipe connects to said fourth pipe, wherein said fourth pipe connects to said fourth tank, wherein said fourth pipe connects to said third tank, wherein said first pipe extends along a path, wherein at each point on said path, said first pipe extends along a direction parallel to a vector that has a first component, a second component, and a third component, wherein said first component is parallel to the direction of a gravity vector, wherein said second component is orthogonal to the first component, wherein said third component is orthogonal to the first component, wherein said second component is has a magnitude of zero, and wherein said third component has a magnitude that is equal to that of said second component.

* * * * *